United States Patent [19]

Dei et al.

[11] Patent Number: 4,763,889

[45] Date of Patent: Aug. 16, 1988

[54] PAPER FEEDER

[75] Inventors: Katsuhito Dei, Kawasaki; Junichi Kimizuka, Yokohama; Junji Ichikawa, Kawasaki, all of Japan

[73] Assignee: Canon Kabushiki Kaisha, Tokyo, Japan

[21] Appl. No.: 802,627

[22] Filed: Nov. 29, 1985

Related U.S. Application Data

[63] Continuation of Ser. No. 405,613, Aug. 5, 1982, abandoned.

[30] Foreign Application Priority Data

Aug. 13, 1981 [JP] Japan ..... 56-125948
Aug. 13, 1981 [JP] Japan ..... 56-125949

[51] Int. Cl.[4] ..... B65H 3/44; B65H 5/26

[52] U.S. Cl. ..... 271/9; 271/259; 355/14 SH

[58] Field of Search ..... 271/9, 164, 171, 127, 271/157, 258–259; 355/3 SH, 14 SH; 133/1 R, 2, 4 R

[56] References Cited

U.S. PATENT DOCUMENTS

| | | | |
|---|---|---|---|
| 3,977,666 | 8/1976 | Suzuki et al. | 271/164 |
| 4,265,440 | 5/1981 | Shibazaki et al. | 271/9 |
| 4,347,924 | 9/1982 | Hayashi et al. | 133/2 |
| 4,406,537 | 9/1983 | Mori | 271/9 |

*Primary Examiner*—Michael S. Huppert
*Attorney, Agent, or Firm*—Fitzpatrick, Cella, Harper & Scinto

[57] ABSTRACT

A paper feeder for an electronic copying machine or the like has a plurality of cassettes for storing paper sheets, feeding mechanisms for feeding the paper sheets from a selected cassette, detectors for detecting the size, feeding direction or presence or absence of the paper sheets in the selected cassette, a CPU for performing an automatic change from a cassette with no paper sheets to a cassette storing paper sheets of the same size and feeding direction, and an automatic changer for prohibiting or selecting the automatic changing mode. An accidental automatic change between the cassettes is prevented.

15 Claims, 11 Drawing Sheets

| | BIT3 | BIT2 | BIT1 | BIT0 |
|---|---|---|---|---|
| 0 | FLGA | SWAFLG | SWBFLG | SWCFLG |
| 1 | | | CNTA | |

PAPER FEEDER

This application is a continuation, of application Ser. No. 405,613 filed Aug. 5, 1982, now abandoned.

BACKGROUND OF THE INVENTION

1. Field of the Invention

The present invention relates to a paper feeder in a recording apparatus such as a copying machine, a laser beam printer or the like and, more particularly, to a paper feeder which has a plurality of paper feed sources which may be automatically changed.

2. Description of the Prior Art

A conventional paper feeder for an image recording apparatus such as an electrophotographic copying apparatus is known wherein a plurality of paper feed sources are automatically changed. More specifically, a paper feeder which has two paper feed sources or two cassettes is known. In this paper feeder, only if the paper sheet sizes are the same, the paper sheets in the second cassette are fed when the first cassette is empty.

A paper feeder of the type as described above is conventionally used in a copying machine with a plurality of paper feed sources. A method has been proposed wherein, when a paper feed source is empty, paper sheets of the same size are continuously fed from another paper feed source. However, various types of paper sheets are recently used in recording apparatuses such as printers or copying machines, which include color paper sheets, drawing copying paper sheets, transparent sheets, label paper sheets, and format paper sheets in addition to general white sheets. Furthermore, paper sheets of the same size may be fed along their short sides or long sides. Assume that automatic changing of paper feed sources is performed by discriminating only the size of the paper sheets in a recording apparatus. If general paper sheets are stored in a first paper feed source, if drawing copying paper sheets of the same size as that of the general paper sheets are stored in a second paper feed source, and if an "empty state" of the first paper feed source is detected during the paper feeding operation, the recording paper sheets are inadvertently changed from the general paper sheets to the drawing copying paper sheets. This results in waste of the drawing copying paper sheets. If automatic changing is made between paper feed sources of different feeding directions, all the information may not be recorded completely.

This not only results in extra work on the side of the operator but also in waste of paper sheets.

SUMMARY OF THE INVENTION

It is an object of the present invention to provide a paper feeder which eliminates the problems of the prior art, which is easy to operate, and which allows easy automatic changing between paper feed sources.

It is another object of the present invention to provide a paper feeder which allows selective automatic changing of paper feed sources.

It is still another object of the present invention to provide a paper feeder which allows prohibition or selection of the automatic changing function of paper feed sources.

The above and other objects of the present invention will become apparent from the following description.

DETAILED DESCRIPTION OF THE PREFERRED EMBODIMENTS

The preferred embodiments of the present invention will now be described with reference to the accompanying drawings.

Figures 1, 3:
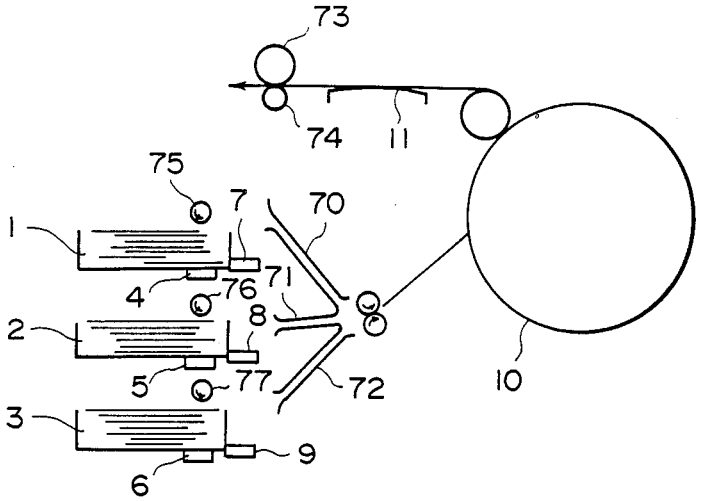
FIG. 1 is a sectional view of a paper feeder according to an embodiment of the present invention.
FIG. 3 is a view showing the RAM map.

FIG. 1 shows the configuration of a paper feeder and related equipment when the present invention is applied to a copying machine wherein paper feed sources are three cassettes. In a well known manner, an electrostatic latent image is formed on a photosensitive drum 10 and is developed by a charger, an exposure unit, and a developing unit (not shown). Vertically arranged cassettes 1, 2 and 3 store copying paper sheets onto which the image formed on the photosensitive drum 10 are transferred. Cassette paper detectors 4, 5 and 6 for detecting the presence or absence of paper sheets in the cassettes 1, 2 and 3 are respectively mounted thereon. Size detectors 7, 8 and 9 for detecting the sizes of the paper sheets by the known means such as cassette pawls indicating the sizes are similarly mounted on the cassettes 1, 2 and 3, respectively. The cassette 1 and the detectors 4 and 7 make up a first paper feed source; the cassette 2 and the detectors 5 and 8 make up a second paper feed source; and the cassette 3 and the detectors 6 and 9 make up a third paper feed source.

As will be described later, when one of the cassettes 1, 2 and 3 is selected, an associated one of pickup rollers 75, 76 and 77 is driven to feed the paper sheet stored in the selected cassette onto the photosensitive drum 10 through an associated one of guides 70, 71 and 72. Thereafter, the toner image formed on the photosensitive drum 10 is transferred onto the paper sheet and is fixed by a fixing unit 11. The paper sheet with the fixed image thereon is exhausted through exhaust rollers 73 and 74.

Figure 2:
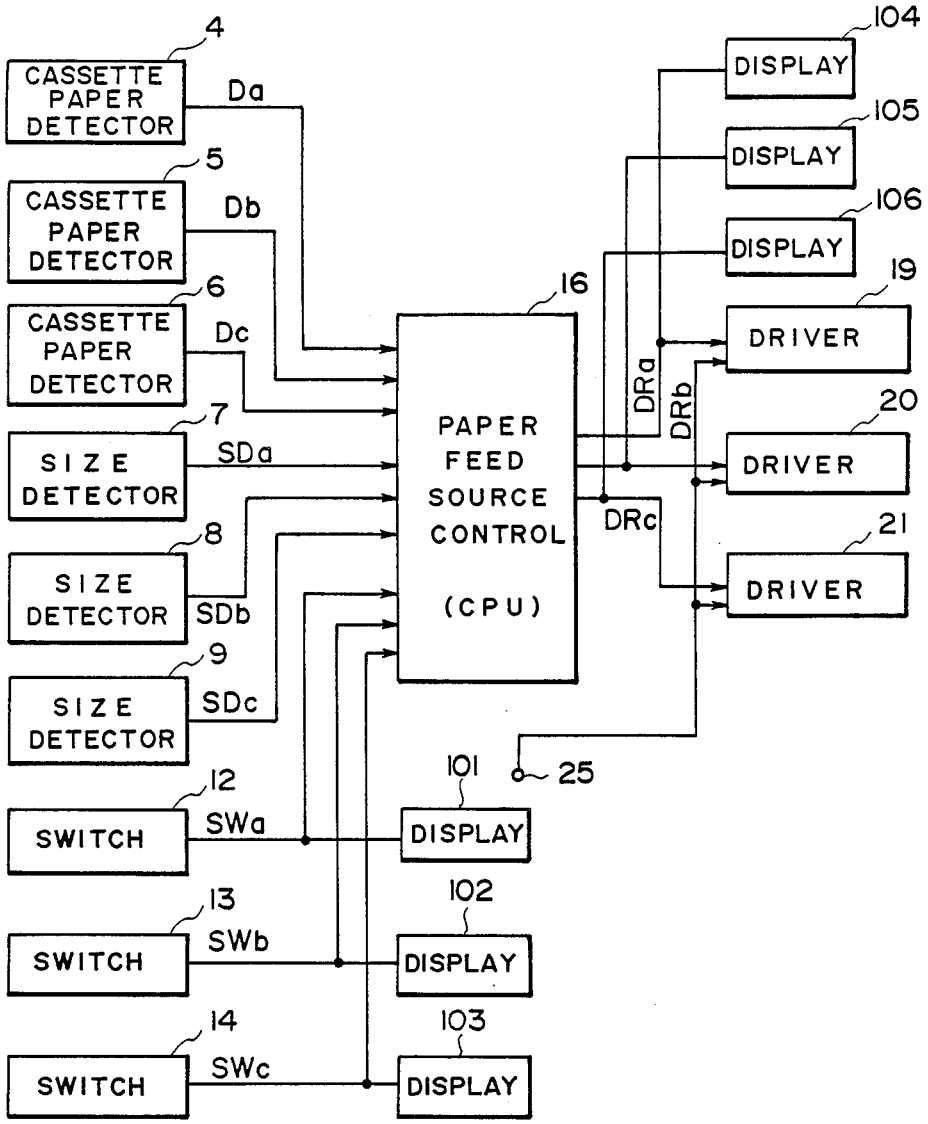
FIG. 2 is a control block diagram of the paper feeder of the present invention.

FIG. 2 is a block diagram showing the configuration of the paper feeder of the present invention. Referring to FIG. 2, upon detection of the paper sheets, the cassette paper detectors 4 and 5 and 6 respectively supply signals Da, Db and Dc to a paper feed source control 16 (a microcomputer such as NEC μPP7801G; to be referred to as a CPU for brevity hereinafter). Similarly, the size detectors 7, 8 and 9 supply signals SDa, SDb and SDc representing respective paper sizes to the CPU 16. Snap switches 12, 13 and 14 respectively instruct operation of the first through third paper feed sources. When the snap switches 12, 13 and 14 are operated, they respectively supply signals SWa, SWb and SWc to the CPU 16 and to displays 101, 102 and 103, respectively.

The CPU 16 processes the respective input signals and generate signals DRa, DRb and DRc based thereon. In synchronism with the paper feed timing pulses applied to a terminal 25, an associated one of drivers 19, 20 and 21 is driven to thereby drive an associated one of pickup rollers 75, 76 and 77. A desired paper sheet is thus fed. The signals DRa, DRb and DRc are also supplied to displays 104, 105 and 106 which display the selected cassette. The snap switches 12 to 14 and the displays 101 to 106 may alternatively be arranged on a control panel, for example, of the copying machine.

FIG. 3 shows the RAM map of the CPU 16. One-bit flags SWAFLG, SWBFLG and SWCFLG temporarily store data indicating the states of the snap switches 12, 13 and 14, respectively. A counter CNTA counts the number of switches which are ON simultaneously among the snap switches 12, 13 and 14. A flag FLGA indicates whether the automatic changing mode of paper feed sources is selected.

The mode of operation of the paper feeder of the present invention will now be described with reference to FIG. 4. In the normal operation, the flags SWAFLG, SWBFLG and SWCFLG within the RAM of the CPU 16 are set in step 26 of the flowchart shown in FIG. 4. In step 27, the counter CNTA assigned to the memory area in the CPU 16 is cleared. In step 28, the state of the signal SWa output from the snap switch 12 is checked to see if the switch 12 is ON. If YES in step 28, the flag SWAFLG is set in step 29 and the counter CNTA is incremented by one in step 30.

In steps 31 to 36, the states of the signals SWb and SWc from the snap switches 13 and 14, respectively, are checked in order to count, with the counter CNTA, the number of switches which are ON simultaneously among the snap switches 12, 13 and 14. In step 39, it is discriminated if the count of the counter CNTA is more than 1. If YES in step 39, it means that more than one paper feed sources are selected simultaneously.

The flag FLGA is then set. If more than one paper feed sources are selected, selection of the paper feed sources is performed by the CPU 16. The CPU 16 first searches for a paper feed source storing paper sheets according to the predetermined priority. If there is no paper sheet remaining in the paper feed source of a highest priority, the CPU 16 then checks if the paper size of a paper feed source of the next priority matches the desired size and selects a paper feed source storing paper sheets of desired size. The characteristic features of the present invention reside in that selection of the automatic changing mode is discriminated by the states of a plurality of snap switches that are simultaneously ON, and that only a desired paper feed source is selected.

If YES in step 39, the paper size of the paper sheets stored in each cassette is checked in the order of cassettes 1, 2 and 3 in the first embodiment. More specifically, it is discriminated in step 49 if the flag SWAFLG is set. If YES in step 49, it is then discriminated in step 50 if the signal Da is logic level "1" to see if there is any paper sheet remaining in the cassette 1. If YES in step 50, the signal DRa alone goes to logic level "1" to render the driver 19 alone operative.

If NO in step 49 or 50, the flow advances to step 52 wherein it is discriminated if the flag SWBFLG is logic level "1". If YES in step 52 (meaning that the cassette 2 is selected), it is discriminated if the signal Db is logic level "1" to see if there is any paper sheet remaining in the cassette 2. If YES in step 53, it is then discriminated in step 54 if the flag SWAFLG is set or if the cassette 1 is selected. If YES in step 55, it is discriminated in step 56 if the states of the signals SDa and SDb are the same to see if the paper sizes of the cassettes 1 and 2 are the same. If YES in step 55 (meaning that the cassette 1 is not selected), the signal DRb goes to logic level "1" to render the driver 20 alone operative in step 56.

If NO in step 52 (cassette 2 is not selected), in step 53 (cassette 2 is selected but there is no paper sheet stored therein) or in step 55 (cassettes 1 and 2 are selected but the paper sizes do not coincide), it is then discriminated in step 57 if the flag SWCFLG is set. If YES in step 57, it is then discriminated in step 58 if the signal Dc is logic level "1" to see if there is any paper sheet remaining in the cassette 3. If YES in step 58, it is discriminated in step 59 if the flag SWAFLG is set to see if the cassette 1 is selected. If YES in step 59, it is discriminated in step 60 if the states of the signals SDa and SDc are the same if the sizes of the paper sheets in the cassettes 1 and 3 are the same. If YES in step 60, the signal DRc goes to logic level "1" to render the driver 21 alone operative. If NO in step 59 (the cassette 1 is not selected), or YES in step 59 but NO in step 60 (the sizes of the paper sheets in the cassettes 1 and 3 do not coincide), it is then discriminated in step 62 if the flag SWBFLG is set to see if the cassette 2 is selected. If YES in step 62, it is discriminated in step 63 if the states of the signals SDb and SDc are the same to see if the sizes of the paper sheets in the cassettes 2 and 3 are the same. If YES in step 63, the signal DRc is at logic level "1" to render the driver 21 alone operative in step 64.

Figure 4A:
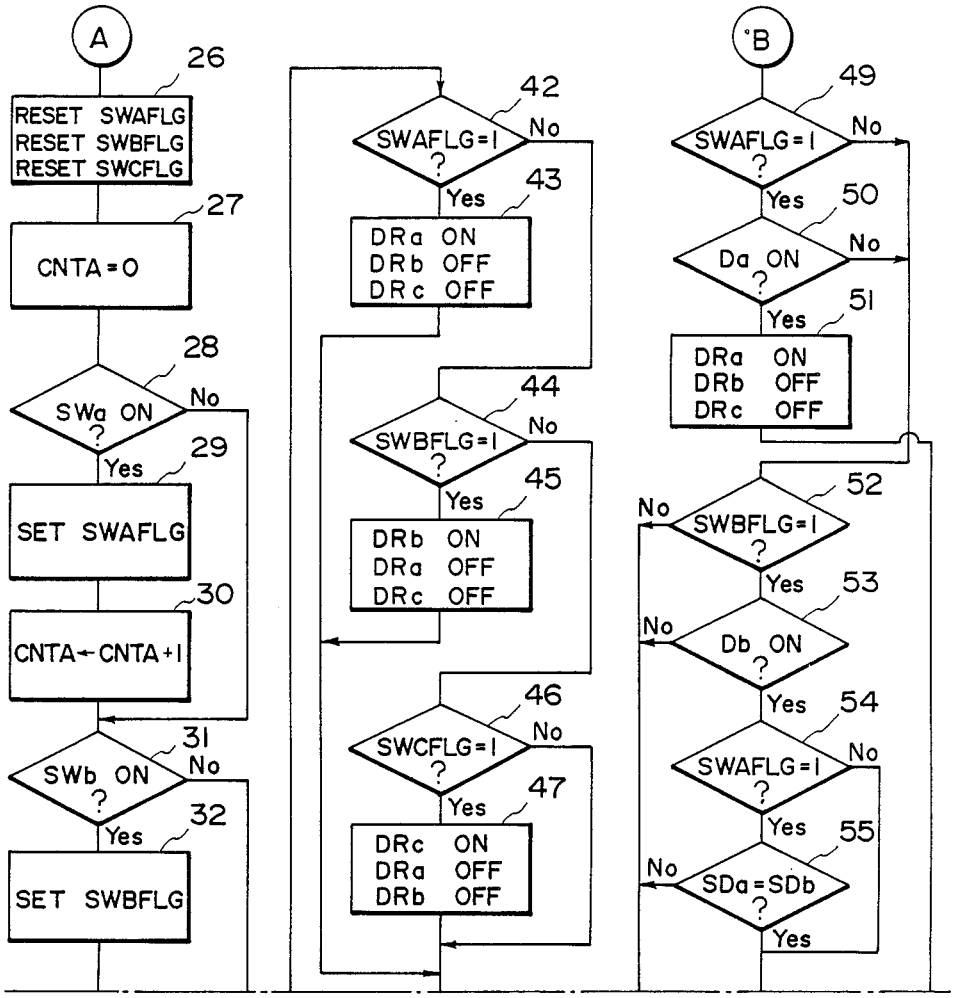
FIGS. 4A and 4B taken together are a flow chart for explaining the operation of the paper feeder according to the present invention.
Figure 4B:
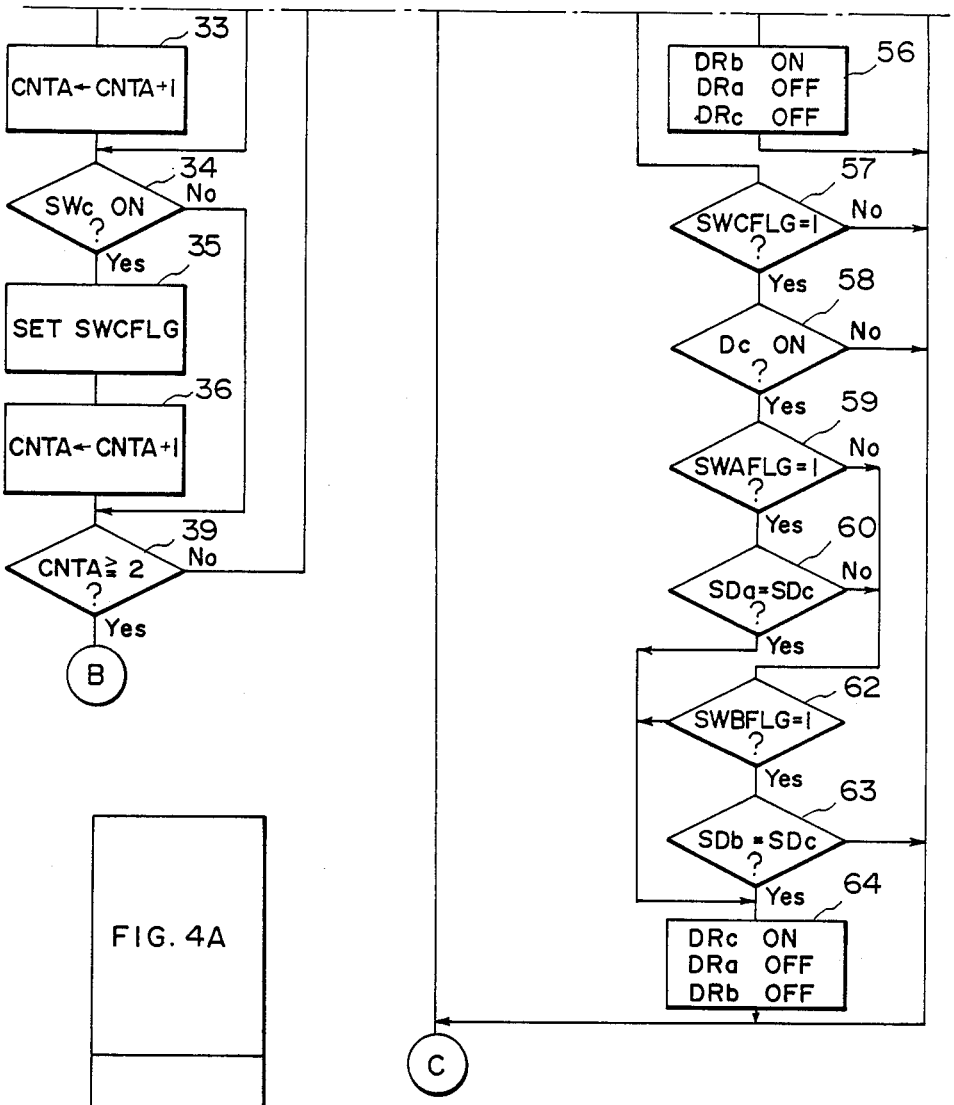
Figure 4:
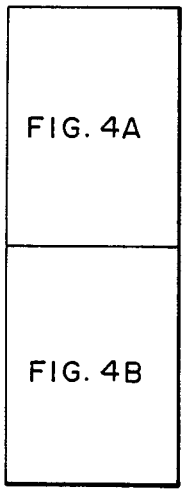
FIG. 4 is a block diagram showing the relationship of the flow chart segments of FIGS. 4A and 4B.

According to the flow control of the flowchart shown in FIG. 4, if none of selected or all paper feed sources stores any paper sheet, or if the paper sizes of paper sheets of higher and lower priorities do not coincide even if the paper feed source of lower priority stores paper sheets, automatic changing of the drivers is not performed. In such cases, it is possible to generate an OFF signal to the feeder from the CPU 16.

Referring back to FIG. 4, if NO in step 39, a single paper feed source is selected. In order to do so, the flag FLGA is first reset. It is then discriminated in step 42 if the snap switch 12 is ON. If YES in step 42, the signal DRa goes to logic level "1" to render the driver 19 alone operative in step 43. Thus, the signals DRb and DRc go to logic level "0" so that the other paper feed sources may not be selected. Similarly, in steps 44 to 47, the similar steps are performed for the remaining snap switches to drive only one driver at a time.

According to this flowchart, if all the switches are OFF, the output state does not change. However, if NO in step 46, all the signals DRa to DRc may go to logic level "0" to disable selection of the paper feed source.

In the embodiment described above, the number of paper feed sources is three; however, it may be 2, or 4 or more. The paper feed source control may be a logic circuit or a computer. Furthermore, the flow of the flowchart shown in FIG. 4 may always form a loop or may be repeated every time the recording operation is instructed. Alternatively, this flow may be repeated every time the absence of paper sheets is detected in a cassette which is currently driven or every time the selection of the paper feed source is changed by the snap switch 12.

Although the switches 12, 13 and 14 are described as snap switches, they may comprise press buttons, touch switches or the like which may be alternately operated. The switching signals SWa, SWb and SWc may be transmitted externally as interface signals.

As has been described above, since the paper feed source to which an automatic change is to be made may be selected, paper sheets of different sizes may be used. The paper sheets of the same size and different materials or different feeding directions may also be used. If no more paper sheet is available from one paper feed source, the paper sheets of the same size and material may be continuously fed from another paper feed source according to the instruction of the operator. Accordingly, accidental automatic changings of paper sheets such as a changing between general paper sheets and drawing copying paper sheets, between paper sheets which are fed along their long sides and which are fed along their short sides, and between the general paper sheets and color paper sheets are prevented. Since paper sheets may be replenished to one paper feed source while the paper sheet are fed from the other paper feed source, continuous operation of the copying machine or the like is facilitated.

Since the paper feeder of the present invention has both the displays for displaying the states of the snap switches or the like and the displays for displaying the states of the paper feed sources which may be selected, the operator may easily confirm his operation and the state of the paper feeder. This is especially effective when the paper feed source is selected by supplying signals externally instead of using the switches.

It is also possible to allow selection of the automatic changing mode of paper feed sources.

Figure 5:
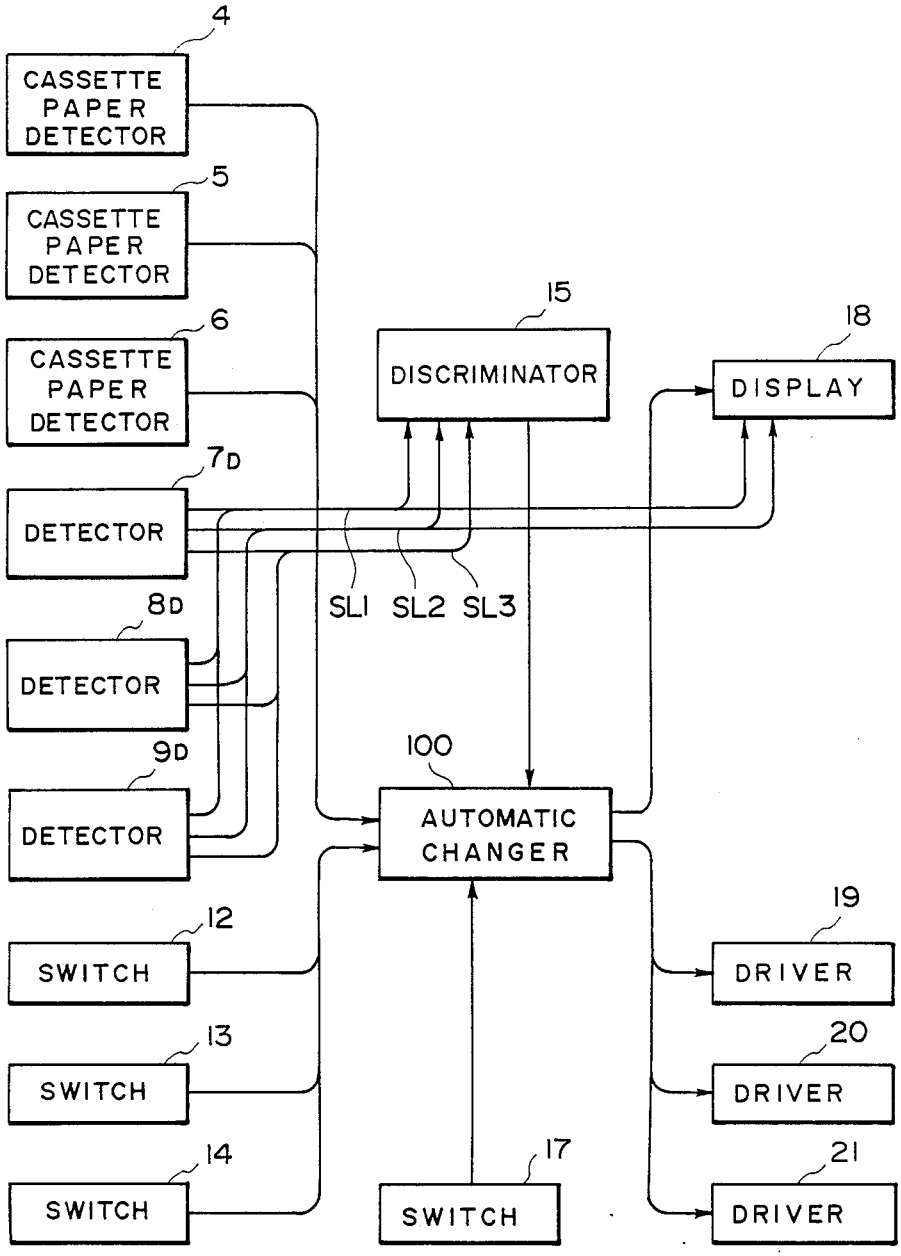
FIG. 5 is a control block diagram of a paper feeder according to another embodiment of the present invention.

FIG. 5 is a block diagram of an embodiment to realize this. In FIG. 5, reference numerals 4 to 6, 12 to 14, and 19 to 21 denote the same parts as those in FIG. 2. The detection signals representing the presence or absence of the paper sheets from the cassette paper detectors 4, 5 and 6 are respectively supplied to an automatic changer 100. The signals representing information on the paper sheets from detectors $7_D$, $8_D$ and $9_D$ are supplied to a discriminator 15. When the snap switch 12, 13 or 14 for selecting the cassette 1, 2 or 3 is selected, the information on the selection is supplied to the automatic changer 100. When the automatic changer 100 is switched to the automatic changing mode by a switch 17, the automatic changer 100 processes the input information to drive one of the drivers 19, 20 and 21 to thereby drive an associated one of pickup rollers 75, 76 and 77. A desired paper sheet is thus fed. Each information on the paper sheet is also supplied to a display 18 which then displays the input information. Referring to FIG. 5, a signal on a signal line SL1 which is supplied to the discriminator 15 is the information about the size of the paper size of each cassette, a signal on a signal line SL2 which is also supplied to the discriminator 15 is the information representing the presence or absence of the paper sheets in each cassette, and a signal on a signal line SL3 which is also supplied to the discriminator 15 is the information representing the direction of the paper sheet in each cassette.

Figure 6A:
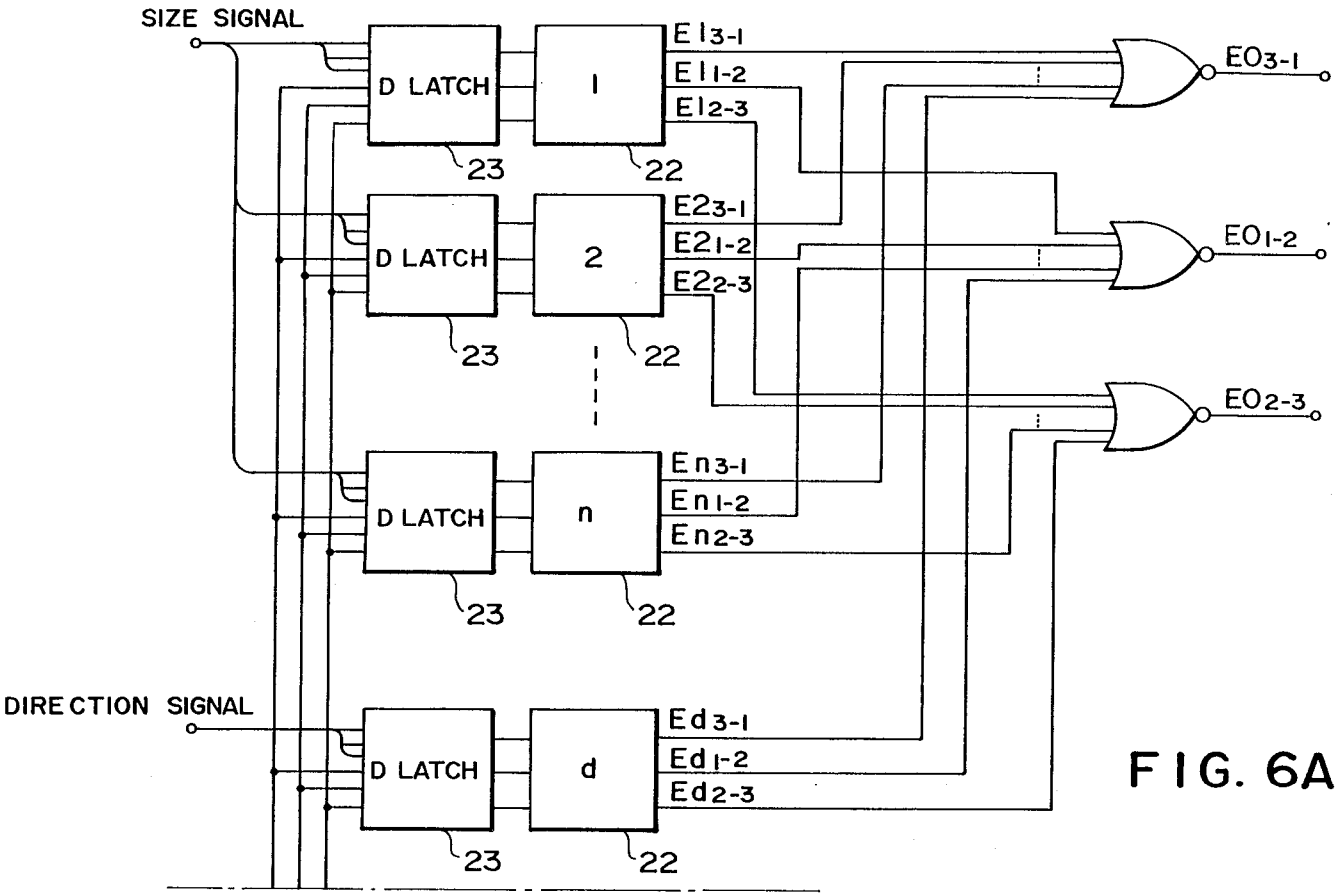
FIGS. 6A and 6B taken together are detailed circuit diagram showing the configuration of the feeder shown in FIG. 5.
Figure 6:
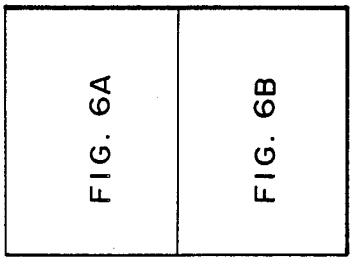
FIG. 6 is a block diagram showing the relationship of the circuit segments of FIGS. 6A and 6B.
Figure 6B:
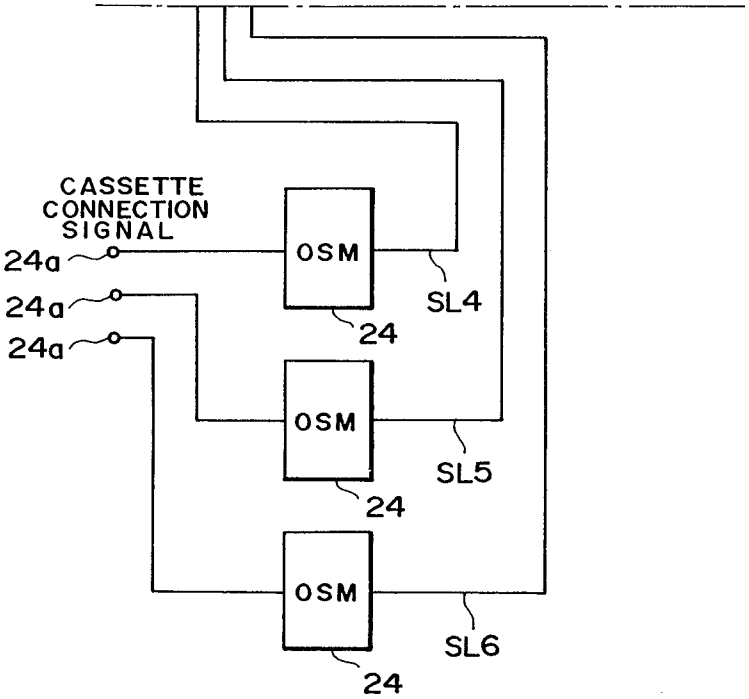
Figure 7:
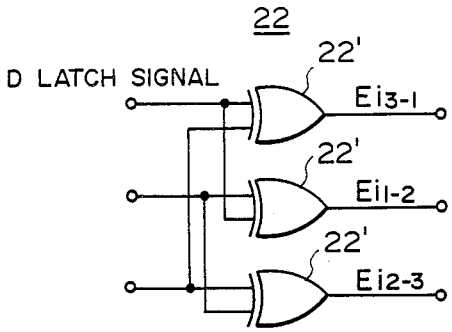
FIG. 7 is a detailed circuit diagram showing part of the feeder shown in FIGS. 6A and 6B.

FIG. 6 shows the configuration of the discriminator 15. Referring to FIG. 6, when the cassettes are inserted, the signals from the detectors $7_D$, $8_D$ and $9_D$ are supplied to input terminals 24*a* respectively of one-shot multivibrators (to be referred to as OSM for brevity hereinafter) 24. Then, the OSMs 24 go to low level for the durations of suitable time constants respectively to latch signals SL4 to SL6 which are supplied to D latches 23. The size signals and the direction signals are supplied to the D latches 23 from the detectors $7_D$, $8_D$ and $9_D$. In response to the signals SL4 to SL6, the D latches 23 latch these size and direction signals. Each size signal has n bits, while each direction signal has 1 bit. Coincidence of respective bits of these signals is detected by blocks 22 each comprising exclusive OR circuits 22', as shown in FIG. 7. If the kth bit coincides with the lth bit (where k and l=1 to 3 in this embodiment), each output $E_{ik-1}$ is at logic level "0" while each output $E_{k-1}$ shown in FIG. 3 is at logic level "1".

Figure 9:
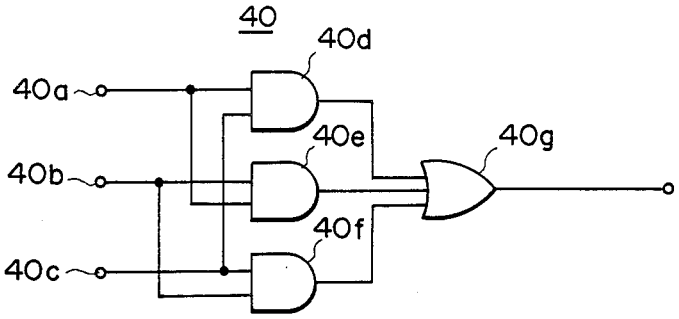
FIG. 9 is a detailed circuit diagram showing part of the circuit shown in FIG. 8.
Figure 8:
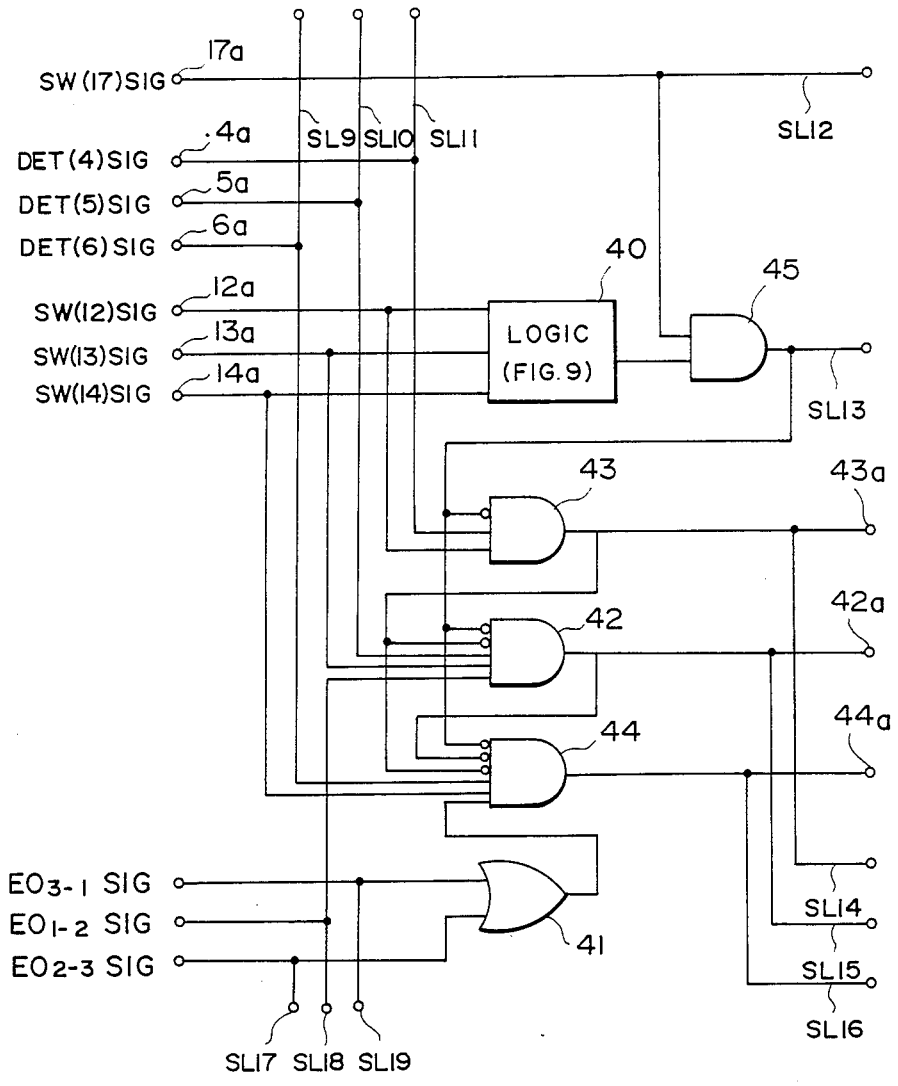
FIG. 8 is a detailed circuit diagram showing part of the feeder shown in FIG. 5.

FIG. 8 shows the configuration of the automatic changer 100. Referring to FIG. 8, a circuit 40 produces a signal of logic level "1" if two or more paper feed sources are selected. As shown in detail in FIG. 9, the circuit 40 receives at its terminals 40*a*, 40*b* and 40*c* the signals from the snap switches 12, 13 and 14, respectively. Two signals are respectively supplied to AND gates 40*d*, 40*e* and 40*f*, and logical products therefrom are supplied to an OR gate 40*g*. The output from the OR gate 40*g* is supplied to a AND gate 45. Referring to FIG. 8, signals SL17, SL18 and SL19 from the outputs $EO_{k-1}$ are respectively supplied to gate circuit 41 and 42. The signals from the snap switches 12, 13 and 14 are supplied to the circuit 40 and to the gate circuits 43, 42 and 44 through terminals 12*a*, 13*a* and 14*a*. The signals from the detectors 4, 5 and 6 are supplied to the gate circuits 43, 42 and 44 through the terminals 4*a*, 5*a* and 6*a*. The outputs from the gate circuits 43, 42 and 44 are supplied to the drivers 19, 20 and 21 through terminals 43*a*, 42*a* and 44*a*, respectively, and are also supplied to the display 18 as the signals SL14, SL15 and SL16. The output signal from the circuit 40 is ANDed by the AND gate 45 with the signal from the switch 17 input thereto through a terminal 17*a*. The signal SL13 output from the AND gate 45 is supplied to the display 18. The signals SL9, SL10, SL11 and SL12 are also supplied to the display 18.

Referring to FIG. 8, the signals SL9, SL10 and SL11 are used by the display 18 to display the presence or absence of the paper sheets in each paper feed source. The signal SL12 is used to display if the mode is the automatic mode or the manual mode. The signal SL13 is used to warn that two or more paper feed sources are not selected in the automatic changing mode. The signals SL14, SL15 and SL16 are used to display the cassette from which the paper sheets are currently fed. The signals SL17, SL18 and SL19 are used to display the paper feed sources storing paper sheets of the same size and same feeding direction.

Referring to FIG. 8, the signal for the switch 17 goes to logic level "1" in the manual changing mode, while it goes to logic level "0" in the automatic changing mode. The signals from the detectors 4, 5 and 6 go to logic level "1" when the corresponding paper sheets are present, while they go to logic level "0" when the paper sheets are absent. The signals from the switches 12, 13 and 14 go to logic level "1" when the cassettes 1, 2 and 3 are selected as paper feed sources, respectively.

Table 1 below shows the truth table of the automatic changer 100 wherein a is the state wherein no driver is selected since two paper feed sources are selected in the manual changing mode; b is the state wherein only one paper feed source is selected; c is the state wherein two paper feed sources are selected in the automatic changing mode; d is the state wherein the paper sheets are different in the state c; and e and f are the states wherein three paper feed sources are selected in the states c and d, respectively. Symbol "—" in the table represents an output of any state.

TABLE 1

| | Input | | | | | | | | | | Output | | |
|---|---|---|---|---|---|---|---|---|---|---|---|---|---|
| | Switch 17 | Switch 12 | Switch 13 | Switch 14 | Detector 140 | Detector 150 | Detector 160 | EO 3-1 | EO 1-2 | EO 2-3 | Driver 19 | Driver 20 | Driver 21 |
| a | 1 | 1 | 1 | — | — | — | — | — | — | — | 0 | 0 | 0 |
| b | — | 1 | 0 | 0 | 1 | — | — | — | — | — | 1 | 0 | 0 |
| | — | 1 | 0 | 0 | 0 | — | — | — | — | — | 0 | 0 | 0 |
| c | 0 | 1 | 1 | — | 1 | 1 | — | — | 1 | — | 1 | 0 | 0 |
| | 0 | 1 | 1 | — | 0 | 1 | — | — | 1 | — | 0 | 1 | 0 |
| | 0 | 1 | 1 | — | 0 | 0 | — | — | 1 | — | 0 | 0 | 0 |
| d | 0 | 1 | 1 | — | 0 | 1 | — | — | 0 | — | 0 | 0 | 0 |
| e | 0 | 1 | 1 | 1 | 1 | — | — | 0 | — | — | 1 | 0 | 0 |
| | 0 | 1 | 1 | 1 | 1 | — | — | — | 0 | — | 1 | 0 | 0 |
| | 0 | 1 | 1 | 1 | 1 | — | — | — | — | 0 | 1 | 0 | 0 |
| f | 0 | 1 | 1 | 1 | 1 | 1 | 1 | 1 | 1 | 1 | 1 | 0 | 0 |
| | 0 | 1 | 1 | 1 | 0 | 1 | 1 | 1 | 1 | 1 | 0 | 1 | 0 |
| | 0 | 1 | 1 | 1 | 0 | 0 | 1 | 1 | 1 | 1 | 0 | 0 | 1 |
| | 0 | 1 | 1 | 1 | 0 | 0 | 0 | 1 | 1 | 1 | 0 | 0 | 0 |

The mode of operation of the paper feeder of the configuration as described above will now be described. When the manual changing mode is selected by the switch 17, only those of the drivers 19, 20 and 21 which correspond to the selected ones of the switches 12, 13 and 14 are rendered operative (a and b in Table 1). If the detector 4, 5, or 6 detects the absence of the paper sheets in the paper feed source, the copying machine causes the display 18 to display the absence of the paper sheets by the signals SL9, SL10 and SL11. If more than one of switches 12, 13 and 14 are selected, it may be warned by the display 18 by the signal SL13 and the copying operation may be interrupted. Alternatively, only the paper feed source of higher order may be driven.

In the manual changing mode, the size detectors cause the display 18 to display the size and feeding direction of the paper sheets which are currently fed.

A case will now be described wherein the automatic changing mode is selected by the switch 17 (see c, d, e and f in Table 1). If only one of the snap switches 12, 13 and 14 is selected, the mode of operation is the same as that in the manual changing mode. However, if more than one of switches 12, 13 and 14 are selected, the discriminator 15 selects one paper feed source wherein the size and feeding direction coincide with those of the currently fed paper sheets. If the absence of the currently fed paper sheets is detected during the copying operation, the automatic changer 100 changes to the paper feed source which has been thus selected.

The paper feed source which is selected first in the automatic changing mode is one of highest priority and has a largest capacity. If the absence of paper sheets is detected in a paper feed source of higher priority, a paper feed source of the next priority is selected.

The paper feed source from which a change has been made is replenished with new paper sheets. If the discriminator 15 discriminates that the size and the feeding direction coincide with those of the currently fed paper sheets through the signals from the detectors 70, 80 and 90, this paper feed source may then be selected any time. If the discriminator 15 discriminates otherwise, the paper feed source may not be selected again.

The display 18 displays the automatic changing mode or the manual changing mode on the basis of the signal SL12, and also displays the absence of paper sheets for each of the paper feed sources on the basis of the signals SL9, SL10 and SL11. On the basis of the signal SL13, the display 18 displays if an automatic change may be made by the signal from the discriminator 15. The display 18 displays the paper feed source to which a change is to be made and the current paper feed source on the basis of the signals SL14, SL15 and SL16. The display 18 also displays the paper feed source of the size and feeding direction coinciding with those of the currently fed paper sheets on the basis of the signals SL17 to SL19.

In this embodiment described above, when the paper sheets are supplied to an empty paper feed source of higher order, the paper feed source may then be able to feed the paper sheets. However, even if the priority of the current paper feed source is low, paper sheets may be continuously fed until there is no more paper sheet, and then a change may be made.

Figure 10A:
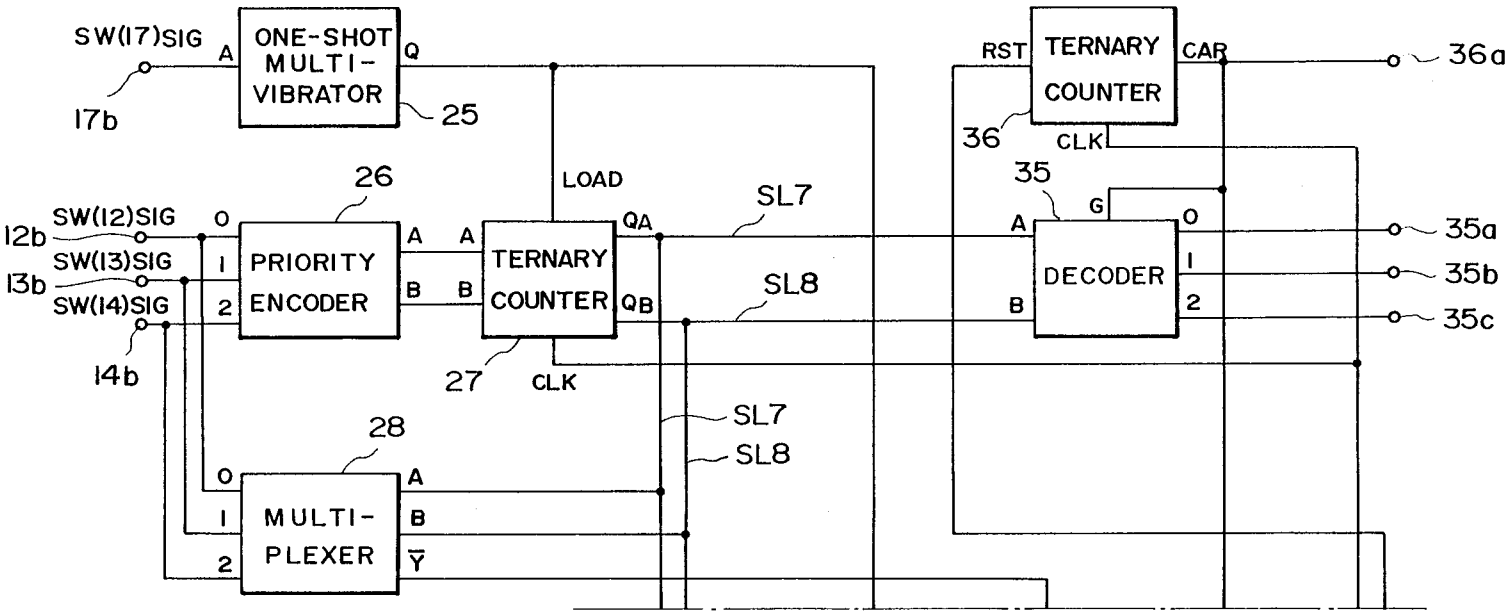
FIGS. 10A and 10B taken together are a block diagram showing a paper feeder according to still another embodiment of the present invention.
Figure 10:
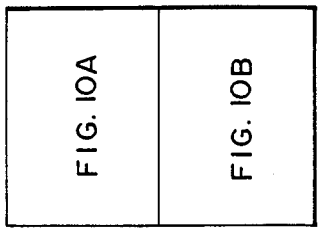
FIG. 10 is a block diagram showing the relationship between the paper feeder segments of FIGS. 10A and 10B.
Figure 10B:
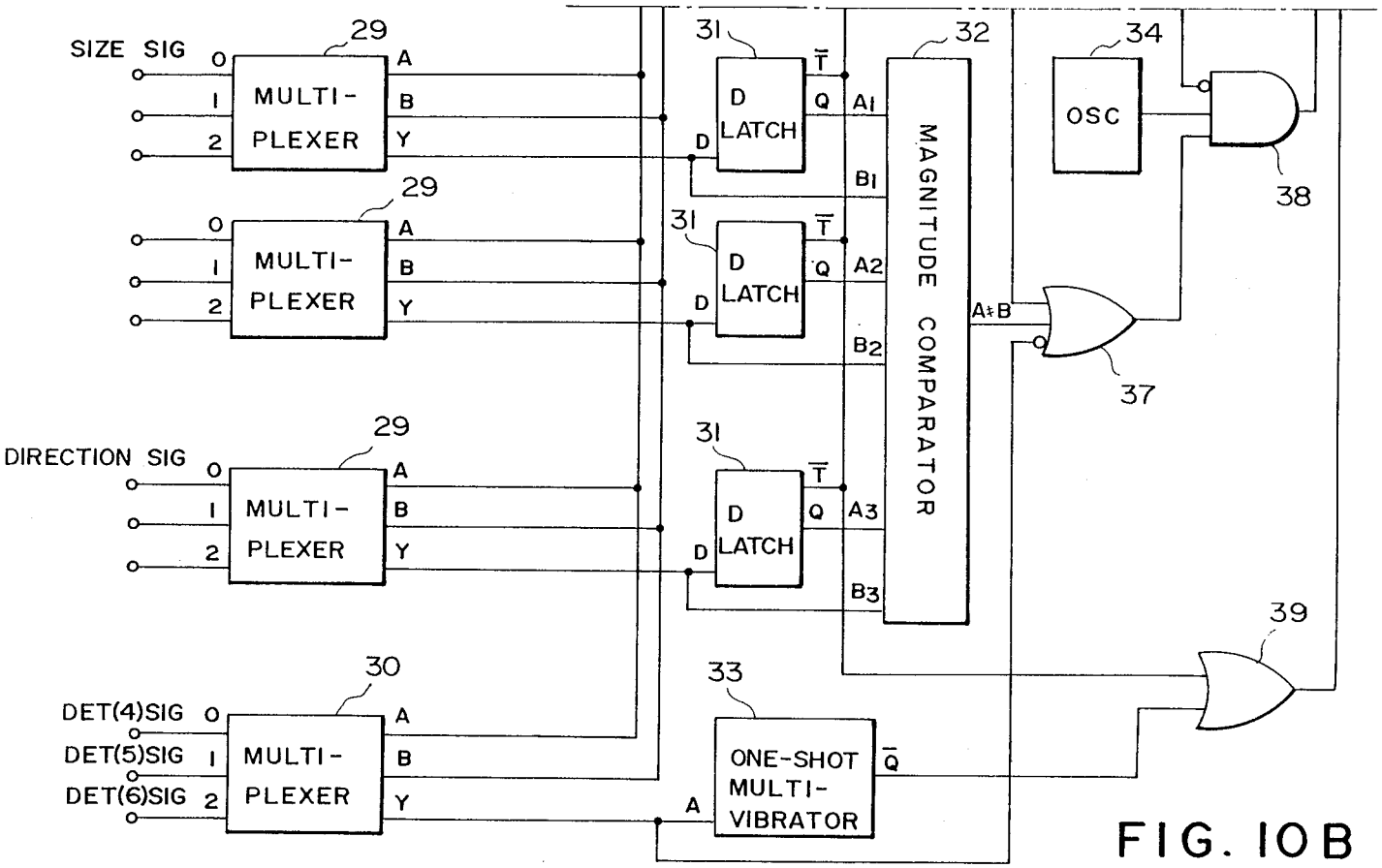

FIG. 10 shows an embodiment for sequentially changing paper feed sources. An output Q of an OSM 25 produces a pulse signal of a predetermined pulse width at the leading edge of the signal supplied to an input A from the switch 17 through a terminal **17*b*. A priority encoder 26 encodes, into a code of 2 bits, with priority inputs 0, 1 and 2 which are supplied from the snap switches 12, 13 and 14 through terminals 12*b*, 13*b* and 14*b*. A ternary counter 27 has a clock input CLK. In response to clock pulses supplied to the clock input CLK, inputs A and B are reset by a signal input to a load input LOAD. Multiplexers 28, 29 and 30 respectively select one of inputs 0, 1 and 2 and produces a signal at an output Y on the basis of the signals SL7 and SL8. Each D latch 31 stores the signal supplied to an input D when an input T falls. An output A≠B of a magnitude comparator 32 goes to logic level "1" when A1≠B1, A2≠B2, or A3≠B3 with inputs A1, A2, A3, B1, B2 and B3. When an input A falls, an output Q of an OSM 33 produces a pulse of a predetermined pulse width. The circuitry further includes an oscillator 34, a decoder 35** for decoding the code or the signals SL7 and SL8, and a ternary counter 36 which has a reset input RST, a clock input CLK and a carry output CAR which produces an OFF signal through a terminal 36*a*. The outputs 0, 1 and 2 from the decoder 35 are coupled to the drivers 19, 20 and 21 through terminals 35*a*, 35*b* and 35*c*, respectively.

The circuitry of this embodiment replaces the discriminator 15 and the automatic changer 100 shown in FIG. 5 and performs an automatic changing operation. Three paper feed sources are used, and the signal representing the size of the paper sheets consists of 2 bits.

When the switch 17 is switched from the manual changing mode to the automatic changing mode by the switch 17, data on the switches among the switches 12, 13 and 14 which are ON, for example, one of the highest priority such as the switch 12 is encoded to a code of "00" by the encoder 26. The code "00" is then stored by the ternary counter 27 and constitute the signals SL7 and SL8 of "0" and "0". Since the input 0 selected by the multiplexer 28 is "1", the output $\overline{Y}$ is "0". The size signal and the direction signal selected by the multiplexer 29 are stored in the D latch 31. The stored contents in the D latch 31 are compared with the output from the multiplexer 29 by the comparator 32. Since they are the same, the output $A \neq B$ of the comparator 32 becomes "0". If the paper sheets are present in the first paper feed source, the output from the multiplexer 30 is "1", the outputs from gates 37 and 39 are "0", and the clock pulses are not supplied to the counters 27 and 36. The output from a gate 39 goes to "1" by the output from the OSM 25, thereby resetting the contents in the counter 36. The decoder 35 selects the driver 19 in accordance with the signals SL7 and SL8. If the absence of the paper sheets in the first paper feed source is detected by the detector 4 which is selected by the multiplexer 30, the counter 36 is reset again, the output from the gate 37 goes to "1", and the output from the oscillator 34 appears at the gate 38 and is supplied to the clock inputs of the counters 27 and 28. When the contents of the counter 27 are incremented by one to become "01", the multiplexers 28 and 30 select the second paper feed source; and respectively check if the automatic changing mode is initiated, if the paper sheets are of the same size and feeding directions as those of the first cassette, and if the paper sheets are present. If even one of the conditions is not satisfied, the output from the gate 37 goes to "1". Another pulse is generated from the gate 38, and the count of the counter 27 is incremented and the next paper feed source is checked. The count of the counter 38 increases with that of the counter 27. When the three paper feed sources are checked, and the carry output from the counter 36 is available, the output of the clock pulses from the gate 38 is prohibited. An OFF signal is generated to interrupt the operation of the copying machine.

As a modification of the embodiment described above, the priority of the paper feed sources and the order of automatic changing may coincide the order of turning on of the switches 12, 13 and 14. Instead of separately arranging the switch 17, the automatic changing mode may be initiated if more than one of the switches 12, 13 and 14 are selected. If the switch 17 is omitted, another switch may be incorporated which simultaneously turns OFF the switches 12, 13 and 14.

The display 18 may discriminate in the manual changing mode if the signals SL17, SL18 and SL19 of the size and direction signals satisfy the conditions of the automatic changing mode and may then display if automatic changing may be performed. The absence of the paper sheets for each paper feed source may be separately displayed by the signals SL9, SL10 and SL11, or the absence of paper sheets of the paper feed source currently feeding the sheets may be displayed by combining the signals SL14, SL15 and SL16. The presence of the paper sheets may be displayed when there is only one cassette is left in which the paper sheets are present, or the number of remaining paper sheets may be displayed.

In summary, since the functions of automatic changing are prohibited or selected, the present invention provides the advantages as follows:

(1) An accidental changing of paper sheets such as a change between general paper sheets and drawing copying paper sheets, between paper sheets which are supplied along their long sides and those which are fed along their short sides, and between color paper sheets and format paper sheets are prevented since automatic changing is possible only for a paper feed source selected by the operator or only when the operator selects the corresponding mode.

(2) While the paper sheets are fed from another paper feed source, the paper feed source with no paper sheets may be replenished with new paper sheets, thus allowing continuous operation.

(3) Since the noncoincidence of the conditions for automatic changing is displayed when the automatic changing mode is selected, a countermeasure may be taken if paper sheets of different sizes or the like are involved.

(4) Since the paper feed source from which the paper sheets are currently fed is displayed in the automatic changing mode, the feeder may not be accidentally disabled so as to replenish new paper sheets to a paper feed source from which the paper sheets are currently fed.

We claim:

1. A paper feeder comprising:

a plurality of storing members for storing sheets;

feeding means for feeding sheets from one of said storing members selected from among said plurality of storing members;

first detecting means for detecting the presence or absence of sheets in said plurality of storing members;

second detecting means for detecting the feeding direction of sheets in said plurality of storing members; and controlling means for automatically changing said selected storing member in accordance with the output of said first and second detecting means, wherein said controlling means automatically changes back to a storing member that had been previously selected when said first detecting means detects the presence of sheets in said previously selected storing member after an automatic change therefrom to another said storing member.

2. A paper feeder according to claim 1, wherein said controlling means performs the automatic change when said detecting means detects the absence of the sheets in said storing member selected.

3. A paper feeder according to claim 1, wherein said plurality of storing members have a priority for the automatic change.

4. A paper feeder according to claim 1, wherein said controlling means performs the automatic change to said storing means of higher priority when said detecting means detects the presence of the sheets in said storing means of higher priority.

5. A paper feeder according to claim 1, wherein said controlling means performs the automatic change to said storing member of higher priority when said detecting means detects the absence of the sheets in said storing member currently selected if the presence of the sheets in said storing means of higher priority is detected by said detecting means.

6. A paper feeder comprising:

a plurality of storing members for storing sheets;

feeding means for feeding sheets from one of said storing members selected form among said plurality of storing members;

detecting means for detecting the presence or absence of sheets in said storing members;

outputting means for outputting data on the sheets stored in said storing members;

specifying means capable of previously specifying plural desired ones from among said plurality of storing members; and controlling means for automatically providing another storing member to be selected in accordance with the data from said outputting means upon detection of the absence of sheets in said one of said storing members by said detecting means, said another storing member being a storing member having sheets of data which is the same as data on the sheets stored in said one of said storing members specified by said specifying means, wherein any storing members other than the specified storing members are not to be selected as an object of the automatic change by said controlling means, even if they include a storing member having sheets of data which is the same as data involved in said one of said storing members.

7. A paper feeder according to claim 6, wherein said outputting means has means for outputting data on a size of the sheets.

8. A paper feeder according to claim 7, wherein said outputting means has means for outputting data on a feeding direction of the sheets.

9. A paper feeder according to claim 6, wherein said outputting means has means for outputting data on a feeding direction of the sheets.

10. A paper feeder according to claim 6, further comprising means for displaying said storing member specified by said specifying means.

11. A paper feeder according to claim 6, wherein said controlling means performs the automatic change to said storing member specified by said specifying means.

12. A paper feeder according to claim 6 or 11, wherein said controlling means performs the automatic change according to a priority of said plurality of storing members.

13. A paper feeder comprising:

a plurality of storing members for storing sheets, each said storing member being assigned a priority;

feeding means for feeding sheets from one of said storing members selected from among said plurality of storing members;

first data output means for outputting first data on a size of the sheets stored in said storing members;

second data output means for outputting second data on a feeding direction of the sheets stored in said storing members;

first selection control means for controlling said feeding means in such a manner that in the event that there are plural storing members each involved in the same data as the other in both the first data and the second data, a higher priority of storing member is automatically selected in accordance with a predetermined priority so that said feeding means feeds the sheets from the selected one of said plural storing members; and second selection control means responsive to the outputs of said first and second output means for controlling said feeding means in such a manner that when the storing member selected by said first selection control means has become empty, another storing member, which is the same as said selected storing member regarding coincidence in both the first data and the second data, is selected in accordance with said predetermined priority so that said feeding means feeds the sheets from the selected another storing member;

wherein, when the storing member which has become temporarily empty is supplemented with the sheets on which data involved in both the sheet size and the feeding direction are the same as the previous sheets, said second selection control means is operable to permit the previous storing member to be again selected, but not permitting re-selection even if the storing member is supplemented with sheets on which data involved in either the sheet size or the feeding direction is not the same as the previous sheets.

14. A paper feeder according to claim 13, wherein said predetermined condition is a condition that said detecting means detects the presence of the sheet in said previously selected storing member.

15. A paper feeding comprising:

a plurality of storing members for storing sheets;

feeding means for feeding sheets from one of said storing members selected from among said plurality of storing members;

first detecting means for detecting the presence or absence of sheets in said plurality of storing members;

second detecting means for detecting the feeding direction of sheets in said plurality of storing members;

first selection control means for controlling said feeding means in such a manner that in the event that there are plural storing members each storing the sheets of which a feeding direction is the same as the other, a higher priority of storing member is automatically selected in accordance with a predetermined priority so that said feeding means feeds the sheets from the selected one of said plural storing members; and second selection control means responsive to the outputs of said first and second detecting means for controlling said feeding means in such a manner that when the storing member selected by said first selection control means has become empty, another storing member having sheets, which is the same as said selected storing member regarding coincidence in the feeding direction of the sheets, is selected in accordance with said predetermined priority so that said feeding means feeds the sheets from the selected another storing member;

wherein, when said first and second detecting means detect that the storing member which has become temporarily empty is supplemented with the sheets of which the feeding direction is the same as the previous sheets, said second selection control means is operable to permit the previous storing member to be again selected, but not permitting re-selection even if it is detected that the storing member is supplemented with sheets of which the feeding direction is not the same as the previous sheets.

* * * * *

UNITED STATES PATENT AND TRADEMARK OFFICE

CERTIFICATE OF CORRECTION

PATENT NO. : 4,763,889

DATED : August 16, 1988

INVENTOR(S) : KATSUHITO DEI, ET AL.

It is certified that error appears in the above-identified patent and that said Letters Patent is hereby corrected as shown below:

Title page:

IN [56] REFERENCES CITED

U.S. PATENT DOCUMENTS, --4,314,754 2/1982
Shimizu ..... 355/14-- should be inserted.

COLUMN 2

Line 18, "detailed" should read --a detailed--.
Line 26, "and" should be deleted.
Line 29, "10B;" should read --10B; and--.

COLUMN 3

Line 16, "generate" should read --generates--.

COLUMN 5

Line 33, "paper sheet" should read --paper sheets--.

COLUMN 6

Line 23, "output $E_{k-1}$" should read --output $EO_{k-1}$--.

UNITED STATES PATENT AND TRADEMARK OFFICE

CERTIFICATE OF CORRECTION

PATENT NO. : 4,763,889

DATED : August 16, 1988

INVENTOR(S) : KATSUHITO DEI, ET AL.

It is certified that error appears in the above-identified patent and that said Letters Patent is hereby corrected as shown below:

COLUMN 7

TABLE 1, " Detector 140 Detector 150 Detector 160 "

should read -- Detector 4 Detector 5 Detector 6 --.

COLUMN 8

Line 5, "detectors 70, 80" should read --detectors $7_D$, $8_D$--.
Line 6, "90," should read --$9_D$,--.
Line 60, "produces" should read --produce--.

COLUMN 9

Line 13, "switch 17" should read --changing mode--.
Line 59, "coincide" should read --coincide with--.

COLUMN 10

Line 9, "is" should be deleted.
Line 62, "said detecting means" should read --said first detecting means--.

UNITED STATES PATENT AND TRADEMARK OFFICE

CERTIFICATE OF CORRECTION

PATENT NO. : 4,763,889

DATED : August 16, 1988

INVENTOR(S) : KATSUHITO DEI, ET AL.

It is certified that error appears in the above-identified patent and that said Letters Patent is hereby corrected as shown below:

COLUMN 11

Line 1, "said detect-" should read --said first detect- --.

Line 6, "said de-" should read --said first de- --.

COLUMN 12

Line 36, "paper feeding" should read --paper feeder--.

Signed and Sealed this

Sixth Day of February, 1990

*Attest:*

JEFFREY M. SAMUELS

*Attesting Officer*

*Acting Commissioner of Patents and Trademarks*